United States Patent [19]

Osborne, Jr. et al.

[11] 4,150,677

[45] Apr. 24, 1979

[54] TREATMENT OF TOBACCO

[75] Inventors: J. Scott Osborne, Jr.; Homer A. Hartung; Joseph F. Bebbs, Jr., all of Richmond, Va.

[73] Assignee: Philip Morris Incorporated, New York, N.Y.

[21] Appl. No.: 761,732

[22] Filed: Jan. 24, 1977

[51] Int. Cl.[2] ..... A24B 3/12; A24D 1/00

[52] U.S. Cl. ..... 131/8 R; 131/17 R; 131/143; 131/144

[58] Field of Search ..... 131/8 R, 2, 9, 17, 143, 131/144, 142, 140 R, 140 C; 260/290 A, 291, 292

[56] References Cited

U.S. PATENT DOCUMENTS

| | | | |
|---|---|---|---|
| 3,174,485 | 3/1965 | Griffith et al. | 131/143 |
| 3,424,171 | 1/1969 | Rooker | 131/143 |

OTHER PUBLICATIONS

J. Org. Chem., Vol. 30, 1965, pp. 2918-2921.

*Primary Examiner*—Robert W. Michell
*Assistant Examiner*—V. Millin
*Attorney, Agent, or Firm*—Susan A. Hutcheson; Arthur I. Palmer, Jr.; George E. Inskeep

[57] ABSTRACT

A process is provided for the treatment of tobacco which comprises the steps of: (1) contacting tobacco which contains relatively high quantities of desirable flavorants, and which may also contain relatively high quantities of materials which may produce tar and nicotine in the tobacco smoke, for example, a flavorful bright tobacco, with a stream of non-reactive gas, under conditions whereby the togacco is heated in a temperature range from about 140 to about 180° C., and preferably from about 160 to about 170° C., for a period of time sufficient to result in a weight loss of the tobacco of from about 3 to about 10% in excess of the weight loss represented by oven volatiles as defined herein, (2) condensing volatile constituents of the resulting gaseous stream, for example, by passing the gaseous stream in contact with a surface, maintained at a temperature of from about −78° C. or lower to about 30° C., for sufficient time to form a condensate; and (3) collecting said condensate. The condensate may be used subsequently to flavor a smoking material in order to enhance the organoleptic properties of its smoke.

6 Claims, 7 Drawing Figures

TREATMENT OF TOBACCO

BACKGROUND OF THE INVENTION

In the manufacture of filler material for cigarettes and the like, many attempts have been made to remove particular constituents from tobacco. Various techniques previously proposed in the art have involved volatilizing certain components of the tobacco, for example, by steam or vacuum distillation, or extracting various components from the tobacco with one or more solvents or combinations of solvents or otherwise treating tobacco to provide a tobacco with satisfactory smoking qualities at reduced levels of tar and/or nicotine. However, the tobacco from which these components have been removed has generally been significantly changed by such treatments and often loses many of its desirable characteristics in the process.

Other techniques have been employed or suggested similarly for removing and recovering portions of a tobacco product for incorporation in another tobacco product. However, these techniques generally have been found to be limited in their scope and effectiveness and, often are complex and expensive to perform.

Among the various techniques which have been suggested in the prior art are the following:

U.S. Pat. No. 3,174,485 to Griffith et al. relates to a smoking product comprising tobacco and a flavor and aroma additive which may be obtained by a process which includes the steps of: heating tobacco at about 150° C. and 0.1 mm Hg for 8 hours; condensing the volatile matter released from the tobacco at a temperature of about −78° C.; dissolving the condensate in a light hydrocarbon solvent; extracting the resulting hydrocarbon soluble fraction, in successive washings, with aqueous solutions of 10% sodium carbonate and 10% acetic acid solutions; separating the acidic and basic fractions from the hydrocarbon solvent fraction and removing the hydrocarbon solvent at ambient temperatures under a moderate vacuum to leave a neutral distillate fraction. The neutral distillate fraction obtained from low temperature distillation and referred to as the concentrate is then fractionated by solid-liquid chromatography techniques to provide the desired compounds for addition to the tobacco.

U.S. Pat. No. 3,424,171 to Rooker relates to a process for the production of a nontobacco smoking product. The process comprises providing cured natural tobacco, removing the aromatics naturally contained therein by heating the tobacco, generally in a vacuum, for a protracted period of time at a temperature not exceeding its scorching point of about 350° to 400° F., for example, by dry heating, steam distillation or by using an inert gas, such as nitrogen or carbon dioxide, absorbing the volatilized aromatics on activated charcoal and thereafter extracting the aromatics from the charcoal, for example, by solvent extraction with ethyl ether or a halogenated alkane, and applying said extracted aromatics to vegetable matter to form a smokable product.

South African Pat. application No. 72/3935 to Reemtsma relates to a method for obtaining tobacco aroma substances in which the tobacco is subjected to an extraction treatment with certain solvents or solvent mixtures, isolating only those components which are soluble in said solvent and, after removing solvent, subjecting the components to heat treatment between 30° and 260° C. The purpose of the process is to isolate certain aroma substances free, as far as possible, of undesired associated substances.

In J. Roerasde and C. R. Enzell, J. Agr. Food Chem., Vol. 20, No. 5 (1972) pages 1035–1039, there is described:

> . . . a process where tobacco volatiles were obtained by passing air through cut tobacco at room temperature, and absorbing the volatiles in activated charcoal. It is stated that the use of an inert gas would constitute a safeguard against oxidation.

In a paper by R. R. Johnson and J. A. Nicholson, presented at the 18th Tobacco Chemists' Research Conference (1964), there is described:

> Burley tobacco was heated at 150° C. and 1 mm for 48 hours. Released volatiles were collected in a trap maintained at −50° C. Analysis and identification of compounds are reported.

Despite all of the methods which have been worked on in the past, no completely satisfactory method has been found for obtaining, by simple means, a desirable fraction of flavor factors derived from tobacco. The present invention provides a method for simply removing from tobacco a selected set of volatile flavorants normally produced by the tobacco and forming a part but only a part of the smoke which is delivered to the smoker. These flavorants evolve from the tobacco in a narrow and well defined temperature range in a very short period of time and at atmospheric pressure. The thus isolated flavorants may be combined with another smoking material to enhance the flavor of its smoke. The present process offers advantages over the prior art and particularly Griffith in that it is unnecessary, and, in fact, undesirable to isolate individual components of the initial condensate. There is no assurance that the particular components isolated at 150° C. and 0.1 mm mercury during eight hours by Griffith et al. can truly reproduce the flavor of tobacco smoke, whereas our mixture, although of complex and largely unknown analysis, does, in fact, so reproduce cigarette smoke flavor. Simply by collection and preservation of the condensate, we have captured precisely and essentially all of those flavors of tobacco smoke which are generated by the tobacco itself, and which confer upon tobacco smoke its typical characteristic organoleptic properties. The present invention also provides a number of other benefits, as will be described in greater detail later in this specification.

BRIEF DESCRIPTION OF THE INVENTION

A process is provided for the treatment of tobacco which comprises the steps of: (1) contacting tobacco which contains desirable flavorants, for example, a flavorful bright tobacco, with a stream of nonreactive gas, under conditions whereby the tobacco is heated in a temperature range from about 140° to about 180° C., and preferably from about 160° to about 170° C., for a period of time sufficient to result in a weight loss of the tobacco of from about 3 to about 10% in excess of the weight loss represented by oven volatiles as defined herein, (2) condensing volatile constituents of the resulting gaseous stream, for example, by passing the gaseous stream in contact with a surface, maintained at a temperature of from about −78° C. or lower to as high as 30° C., for sufficient time to form a condensate, (3) collecting said condensate, and (4) thereafter combining said condensate with a smoking material in order to enhance the organoleptic properties of its smoke. If desired, the condensate may be stored, under proper conditions, for future use. In a preferred form of the invention, the condensate is applied to a tobacco-based filler material or the like which has insufficient flavor but which has relatively low quantities of tar- and nicotine-producing materials, whereby the resulting product is a low tar and low nicotine smoking product having a desirably high flavor content.

An additional aspect of the present invention involves reducing the flavor content of a tobacco, for example, an Oriental tobacco, from a level which may be undesirably high to a more desirable level, without otherwise deleteriously affecting the tobacco, to result in a more desirable tobacco, together with a condensate which may thereafter be employed to enhance the qualities of a smoking material which is low in flavor.

DETAILED DESCRIPTION OF THE INVENTION

Figure 2:
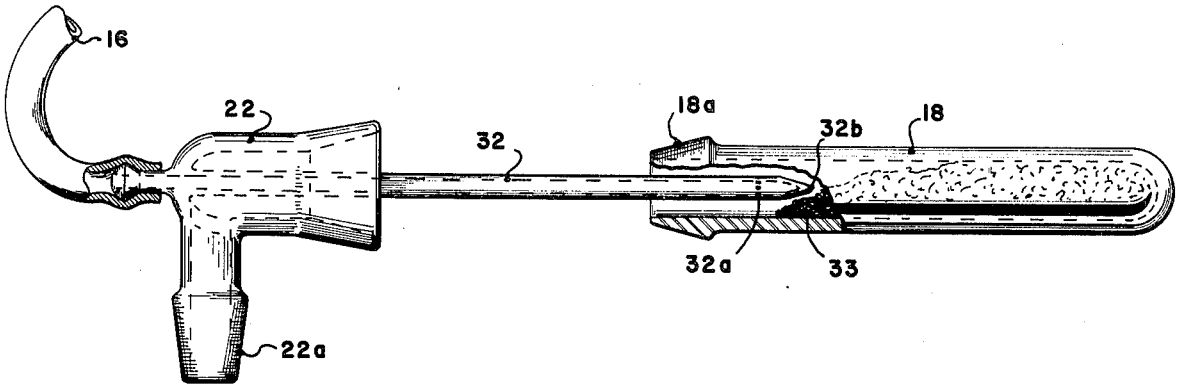
FIG. 2 is an enlarged and more detailed view of part of the apparatus shown in FIG. 1.

Tobaccos which may be employed as a starting material in the process of the present invention may be bright tobaccos, burley tobaccos, Oriental tobaccos, or other tobaccos or combinations of any of these tobaccos. While uncured tobaccos may be employed in the process, the starting materials used are preferably cured tobacco. The curing may be accomplished by any of the commercially known techniques. The moisture content of the tobaccos employed may vary. In the case of cured tobaccos, the moisture content, determined as percent "oven volatiles" or "OV," is preferably between about 9 and 14% by weight. As used herein, the value of "oven volatiles" or "OV" is determined by placing a weighed sample of tobacco in an air-circulating oven and maintaining the sample in the oven, at a temperature of 100° C., for a period of three hours, after which the sample is again weighed. The difference in the two weight values expressed as a percentage of the original weight is defined as "oven volatiles" or "OV."

Since the present process involves the removal of desirable tobacco smoke flavorants, the starting tobacco should contain sufficient flavor materials to produce a suitable condensate for incorporation in other smoking products. Thus, a relatively high flavor tobacco will normally be employed in the present process.

One skilled in the art can readily distinguish between "high flavor tobacco" and "low flavor tobacco" by means such as subjective evaluation, volatile sweep, and to some extent by thermogravimetric analysis which is defined as chemical analysis by measuring the weight changes of a system as a function of increasing temperature. In this particular instance, thermogravimetric analysis has been useful in some instances in selecting high flavor tobaccos suitable for treating according to the process disclosed herein and in addition, has been useful in demonstrating graphically the weight loss in treated tobacco which we believe to be representative of the tobacco flavorants removed in a narrow and well defined temperature range. For purposes of this invention, higher tar and nicotine tobaccos are suitable for use as starting materials since these tobaccos have been found to yield higher flavor.

A preferred nonreactive gas which may be employed in accordance with the present invention is nitrogen. Alternative inert or nonreactive gases which may be employed are those such as argon, helium, carbon dioxide, and mixtures of the same. Gases, either single component or mixtures, which, at temperatures no higher than 180° C., are essentially nonreactive with tobacco or its volatile components may be employed.

During contact with the tobacco, the nonreactive gas may be at a pressure of from about 0.2 to about 10 atmospheres but is preferably at a pressure of about one atmosphere. The gas may be at a temperature of from about 140° to about 180° C., but is preferably at a temperature of from about 160° to about 170° C.

The nonreactive gas should be passed in contact with the tobacco, which may be in any form, including leaf or stems, but which is preferably in the form of fragments, such as the shreds normally employed in smoking articles or the like, in such a manner that the quantity of gas coming in contact with the tobacco provides from about 20 to about 1000 volumes or more, and preferably from about 100 to about 500 volumes, of nonreactive gas, measured at the process pressure, per volume of tobacco being treated per minute.

The temperature of the tobacco during contact with the nonreactive gas should reach a level of 140° to 180° C. and is preferably 160° to 170° C. The temperature may be controlled by heating the inert gas. Heating means, such as heating coils, lamps or the like, may be employed to supplement the heated nonreactive gas or may be used per se to maintain the appropriate heat level in the apparatus which is employed. While a temperature gradient will occur in the tobacco during heating, we have found that the tobacco, to be effectively treated in accordance with the present invention, should reach a temperature not to exceed 180° C., as determind by inserting a thermocouple or similar temperature measuring device in a central portion of the tobacco being heated. The temperature in the heating chamber may vary from the temperature of the tobacco, but will generally be in the range of 180° to 230° C.

The length of time, the temperature to which the tobacco is brought, and the volume of inert gas employed are all factors which will vary somewhat in accordance with the particular tobacco being treated for a desired weight loss of the tobacco of from about 3 to about 10%. As used throughout this specification and claims, the term "weight loss" does not include "oven volatiles" and is defined as the difference between the weight of the tobacco before treatment and the weight of the tobacco after the treatment minus the "oven volatiles" (as defined herein above). For example, assume a tobacco sample which has a 10% OV and weighs 100 pounds is used in the process. Also assume that, after the contact with the inert gas in accordance with this invention, the sample is found to weigh 85 pounds. The weight loss would be 5 pounds; i.e., 100 pounds (starting weight) minus 85 pounds (final weight)

minus 10 pounds (OV weight). This weight loss of 5 pounds, in this case, would, of course, correspond to a weight loss of 5%.

In the case of burley tobaccos having a relatively high flavor content, the weight loss should be between about 3 and 10% and is preferably from about 3 to about 6% and is most preferably about 5%. Generally, at a temperature of from about 160° to about 170° C., the time necessary to accomplish this degree of weight loss will be from about 3 to 10 minutes. For bright tobaccos having a relatively high flavor content, the weight loss should be between about 3 and 10% and is preferably about 7%. Generally, at a temperature of from about 160° to about 170° C., the time necessary to accomplish this degree of weight loss will be from about 3 to 10 minutes. For Oriental tobaccos having a relatively high flavor content, the weight loss should be between about 3 and 9% and is preferably from about 3 to about 7% and is most preferably about 6%. Generally, at a temperature of from about 160° to about 170° C., the time necessary to accomplish this degree of weight loss will be from about 3 to 10 minutes; however, longer time periods may be utilized if desired without adversely affecting the tobacco.

After the inert gas has contacted the tobacco for a sufficient period of time, the volatilized materials are swept by the nonreactive gas to a condensing surface, in order to condense certain materials from the gas phase. The condensing surface is preferably maintained at a temperature of from about −78 to about 30° C. The temperature employed will depend, to a great degree, on the type of equipment, the volume rate of gas flow, and the like. The upper limit of temperature might be somewhat higher if, for example, the condensing surface is cut filler. The condensing conditions and condenser specifications may be readily determined by one skilled in the art.

Ethanol, or other appropriate low molecular weight alcohols or the like, may be employed to collect the condensate from the condensate surface, and several separate washes may be necessary to ensure maximum recovery of the condensate. Following collection, the condensate is stored in closed containers.

The tobacco which has been treated in this manner may then be employed in smoking products but will no longer have the same degree of flavor as it originally possessed. These tobaccos, however, have been found to be substantially unimpaired in terms of their smoking qualities and other properties and where the tobacco has been found to be undesirably high in flavor to begin with, the appropriate use of the present process can bring the tobacco to a desirable level of flavor. When the present process is employed for purposes of bringing a high flavor tobacco to a more acceptable flavor level, the conditions for contact between the inert gas and the tobacco have been found to be somewhat shorter, for the same temperatures, than noted above.

The condensate which is obtained in accordance with the above procedure may then be applied to a smoking substrate, for example, tobacco or a tobacco substitute material or some combination of these materials. A particular embodiment of the present invention involves the use of condensate representing a rich tobacco flavor material in combination with a tobacco which is low in tar and nicotine but which requires flavor enhancement to make it acceptable for smoking purposes.

If desired, the condensate may be kept under appropriate storage conditions for long periods of time before being employed in a smoking composition.

The tobacco which is employed as a starting material may also be a reconstituted tobacco, as long as there are sufficient flavor ingredients to permit their removal by the present process.

The tobacco or other material which may be employed as a substrate for the condensate which is obtained in accordance with the present invention may be reconstituted tobacco, stems or tobacco fines or alternatively a synthetic smoking product. Similarly, the desirable flavors may be obtained by treating stems or other tobacco plant portions with the inert gas as described above.

DESCRIPTION OF THE DRAWINGS

Figure 1:
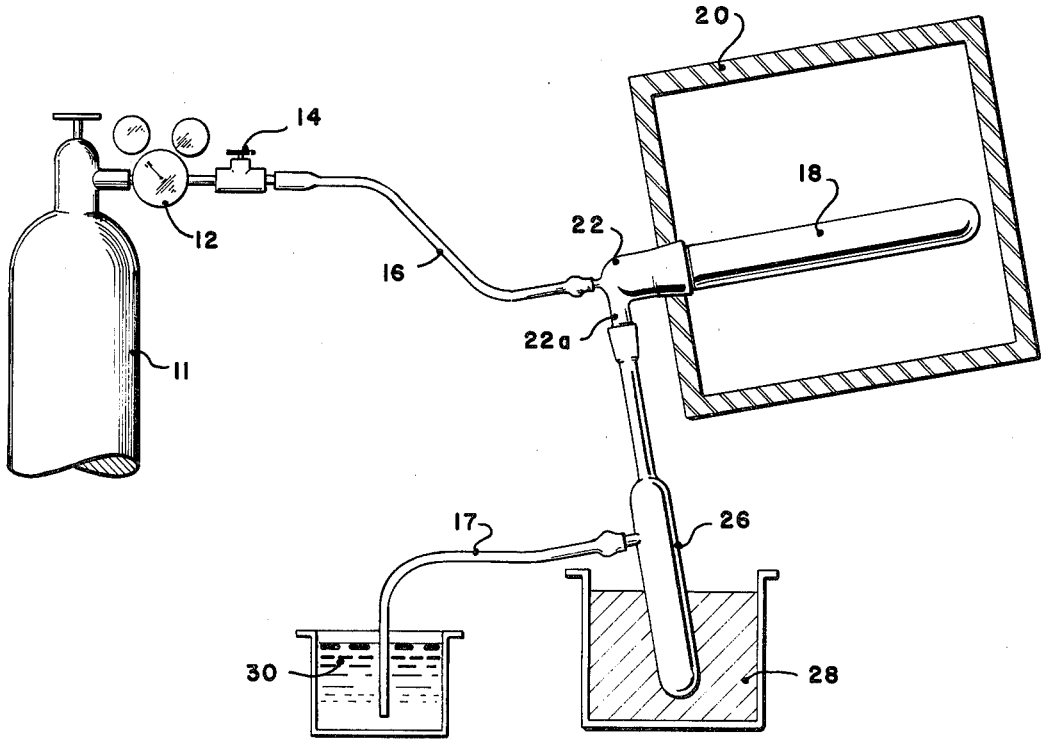
FIG. 1 is a view of a first apparatus for treating small amounts of tobacco.

Referring now to the drawings,

FIG. 1 illustrates a small batch sparging apparatus. The term "sparging" as used hereinafter refers to the process of continuous dispersal of an inert gas within a bed of tobacco and the continuous removal of the same, which results in removal of volatile condensable substances by entrainment in the gas. The term "spargate" refers to the tobacco volatiles condensed from the sparger effluent.

A gas supply 11 equipped with a pressure-reducing valve 12 and a flow control valve 14 is connected via flexible tubing 16 to sparging chamber 18 which is mounted in oven 20. The oven is a standard oven (Precision Scientific Company "Thelco" Model 18 #74461) designed to operate to 200° C., as normally equipped with a fan for forcing convection, a thermostat for temperature regulation, and a thermometer mounted on a 2-inch porthole in the top. The oven is tipped onto its side, and its original bottom end is raised slightly. The thermometer is removed and the sparging chamber 18 is mounted through the porthole at a slight angle to ensure that the condensate formed during sparging will drain towards the condenser 26. The chamber is connected by a glass joint to cap 22 equipped with a sidearm **22*a* which is attached to the condenser. The condenser which is generally maintained in a cooling bath 28, is equipped with a sidearm connected via tubing 17 to receiver 30** which contains a solvent for retaining aerosol particles formed during sparging. In addition, the receiver serves as a flowmeter by rendering the gas stream in bubbles that can be counted.

FIG. 2 is a more detailed view of the sparger shown in FIG. 1. The sparging chamber containing tobacco filler 33 is a large test tube 18 having an outside diameter of about 50 mm, 58 cm long and topped with a 50/50 standard taper glass joint **18*a*. The cap 22 equipped with a 50/50 standard joint designed to fit the test tube 18 is modified to receive a glass tube 32 which extends a small distance through the cap to be connected by tubing 16 to a gas supply. The other end of glass tube 32 is designed to penetrate far enough to almost reach the bottom of test tube 18. Small apertures 32*a* are provided around the circumference of the tube at about one centimeter from its end, and the tube beyond this is drawn to a point 32*b*. Sidearm 22*a*** is connected to a condenser (not shown).

The operation of the apparatus of FIGS. 1 and 2 is as follows. Approximately 50 to 60 grams of shredded tobacco filler having about 12% oven volatiles is placed in sparging chamber 18 and the chamber is closed by cap 22. Nitrogen from supply tank 11 at room temperature and atmospheric pressure is used to purge the system of air, then the oven thermostat is set and maintained at 165° C. while nitrogen at atmospheric pressure is passed via tubing 16 through tube 32 and out apertures 32*a* (FIG. 2) into intimate contact with the tobacco. The condenser 26 maintained at about 25° C. by means of water bath 28 is connected via tubing 17 to receiver 30 which contains ethanol to trap any overflow of volatile materials released from the tobacco during sparging and also aids in establishing the gas flow rate.

When the process is complete (i.e., the desired weight loss has been attained), the nitrogen flow is stopped and the apparatus is cooled. The spargate deposited in condenser 26 is collected using a solvent such as ethanol and combined with the ethanol of receiver 30. The spargate thus collected may be stored or used immediately to up-grade low flavor tobacco.

Figure 3:
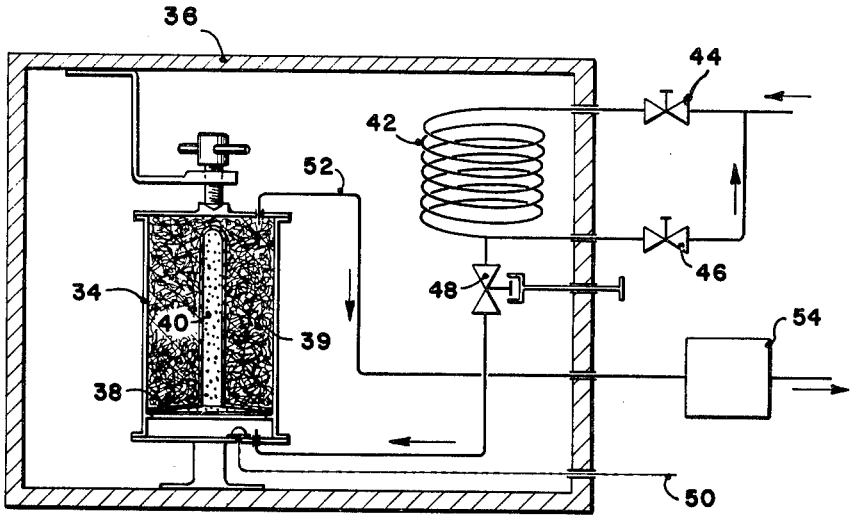
FIG. 3 illustrates an apparatus used for treating larger amounts of tobacco.

A sparging apparatus designed for treating large batches of tobacco, (for example, about 500 grams of tobacco) is illustrated in FIG. 3. A cylindrical sparging chamber 34 is mounted in oven 36. The chamber is equipped with a perforated plate 38 designed to support cut tobacco filler 39. A perforated tube 40 extends vertically in the chamber and is connected to a gas supply via heated coiled tubing 42. Valve means 44, 46, and 48 are provided for regulating gas flow through the system and for recirculating gas through heated coil 42. Thermocouple 50 extends through the oven and into the floor of the sparging chamber.

The process of sparging using the apparatus of FIG. 3 is as follows. Approximately 500 grams of tobacco is placed in sparging chamber 34 and the system is closed and purged of air. The oven 36 is brought to 165° C. Nitrogen, heated to about 165° C. by passing through coiled tubing 42 is introduced into heated chamber 34 via perforated tube 40. The spargate volatilized from the treated tobacco passes through take-off line 52 and is recovered in condenser flask 54 which is maintained at a temperature of about 0° C. After cooling the apparatus, the spargate is collected by washing the flask with a solvent such as ethanol and is subsequently used to enhance low flavor tobacco.

Figure 4:
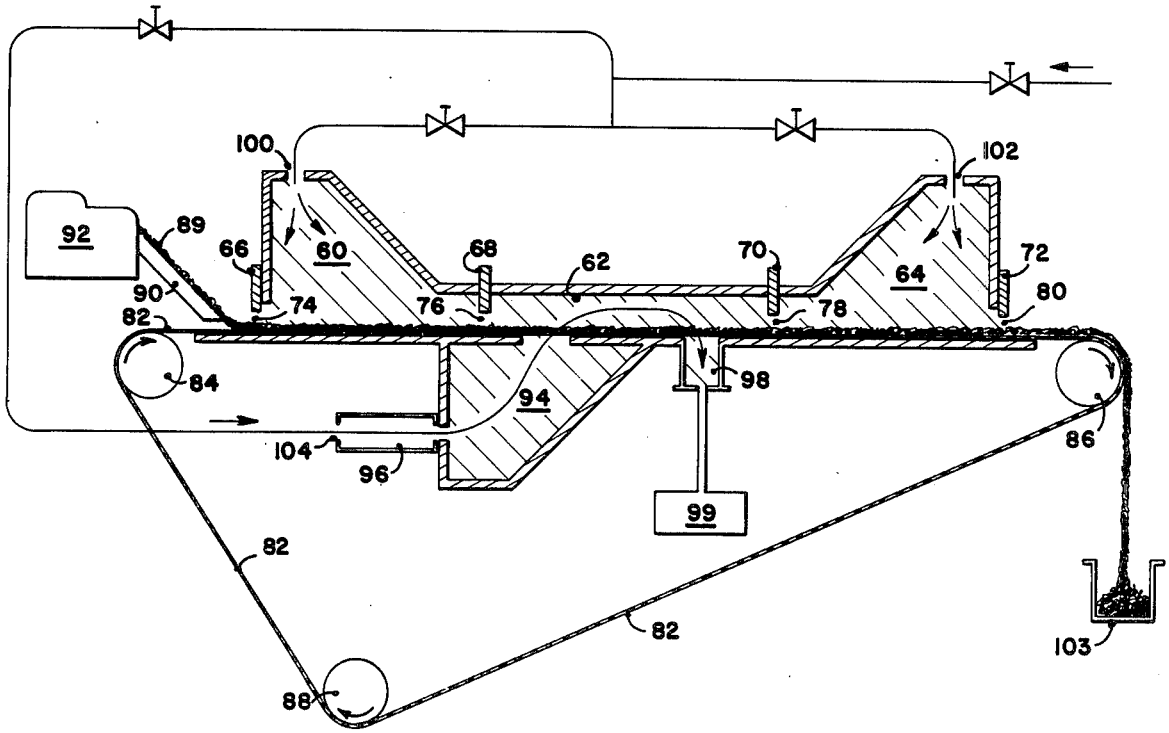
FIG. 4 is a view of an apparatus used for a continuous treatment of tobacco.

FIG. 4 illustrates an apparatus designed to perform a continuous sparging operation. The apparatus comprises a series of chambers 60, 62, and 64 which are respectively separated from each other and from the outside atmosphere by flow regulating gates 66, 68, 70, and 72. The gates are provided with openings 74, 76, 78, and 80 for a transporting device 82 here shown as a conveyor belt which is constructed of woven metal and is driven by one or more of three uplleys 84, 86, and 88 through a chain drive, a variable speed transmission, and an electric motor (not shown). Guides keep the belt centered on the pulleys.

An independently powered belt 90 feeds a thin ribbon of tobacco filler 89 onto belt 82 from hopper 92. The tobacco is fed at approximately 1 lb./hr. through first gate 66 against a slight flow of inert gas entering via inlet 100. The first chamber 60 serves to purge the tobacco of air at room temperature. On passing through opening 76 adjacent to gate 68, the tobacco meets an updraft of heated inert gas which enters via inlet 104 and passes through plenum 94 equipped with heater 96. Additional heat may be supplied by mounting radiant heaters in chamer 62. Volatilized flavor substances are swept out of the tobacco by the gas and passed through heated duct 98 maintained at a temperature of about 165° C. prior to entering the condensing system 99 which may be Elmenhorst traps, originally designed for collecting cigarette smoke condensate. The traps are generally cooled in a dry ice bath to ensure maximum recovery of the condensate. The sparged tobacco is then conveyed through the opening 78 adjacent to gate 70 into the third chamber 64 where it is cooled by inert gas at ambient temperature entering via inlet 104. The cooled tobacco then passes through opening 80 adjacent to gate 72 into an appropriate collection container 103.

The condensed flavor substances (spargate) are recovered by washing the condensers 99 with a suitable solvent such as ethanol. The spargate solution may then be stored in closed containers for future use in enhancing the organoleptic properties of low flavor tobacco.

The insert gas used throughout the system is conveniently piped through a main control panel. A constant speed pump is provided for recirculating the gas drawn from the sparging chamber 62 and traps 99 back through the heaters and/or the two end chambers. The feed rate of the system may be adjusted by means of a throttling valve (not shown).

Figure 5:
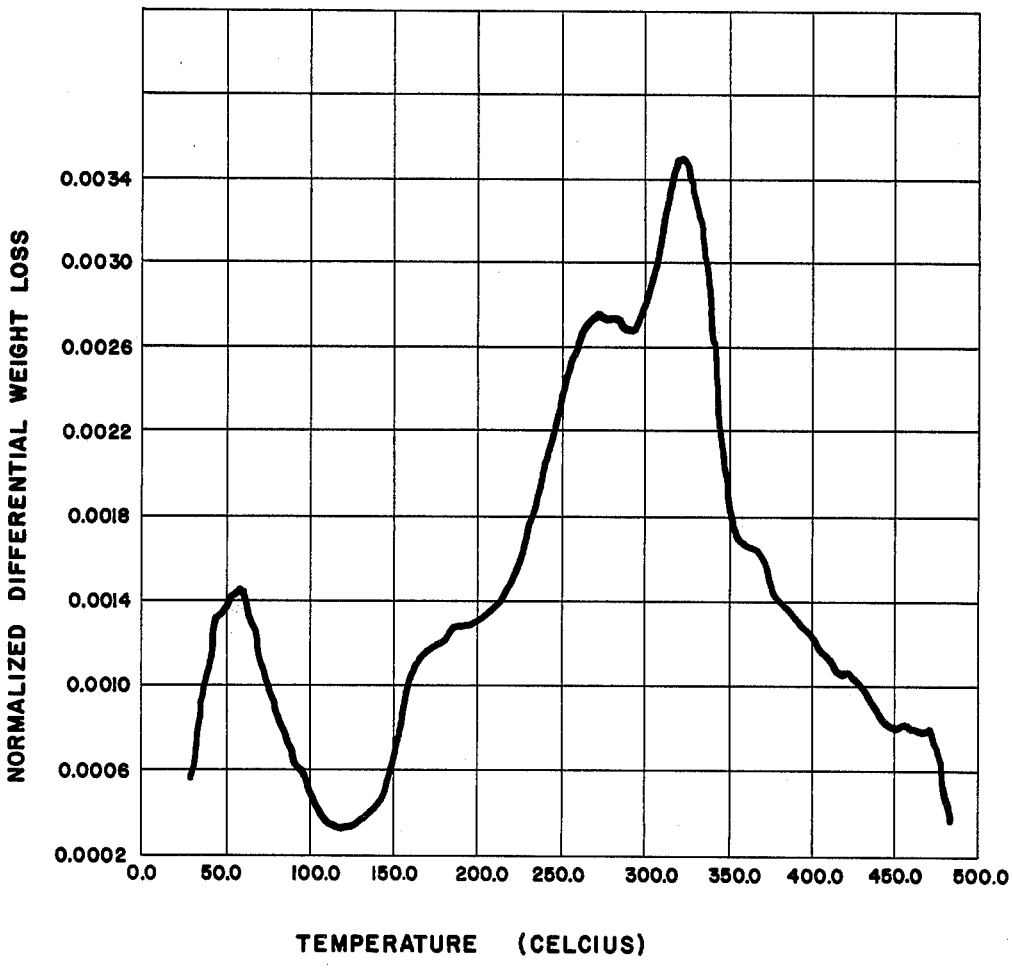
FIG. 5 is a thermogravimetry curve presented in the form of derivatives showing the relative yield of high flavor bright tobacco.

FIG. 5 illustrates graphically the results of thermogravimetric analysis of bright, high-flavor tobacco. All analyses were conducted using a "DuPont" model 950 Thermogravimetric Analyzer following procedures well known in the art. The data shown are derived by heating tobacco at a rate of 10° C. per minute in a controlled environment under nitrogen flowing at 100 cc per minute. On the graph shown, the normalized differential weight loss is plotted versus the tobacco temperature in degrees Celcius. The graph demonstrates a welldefined weight loss due to volatilization of tobacco constituents in a narrow temperature band of about 165 ± 5° C. which is the preferred temperature range of the present invention.

Figure 6:
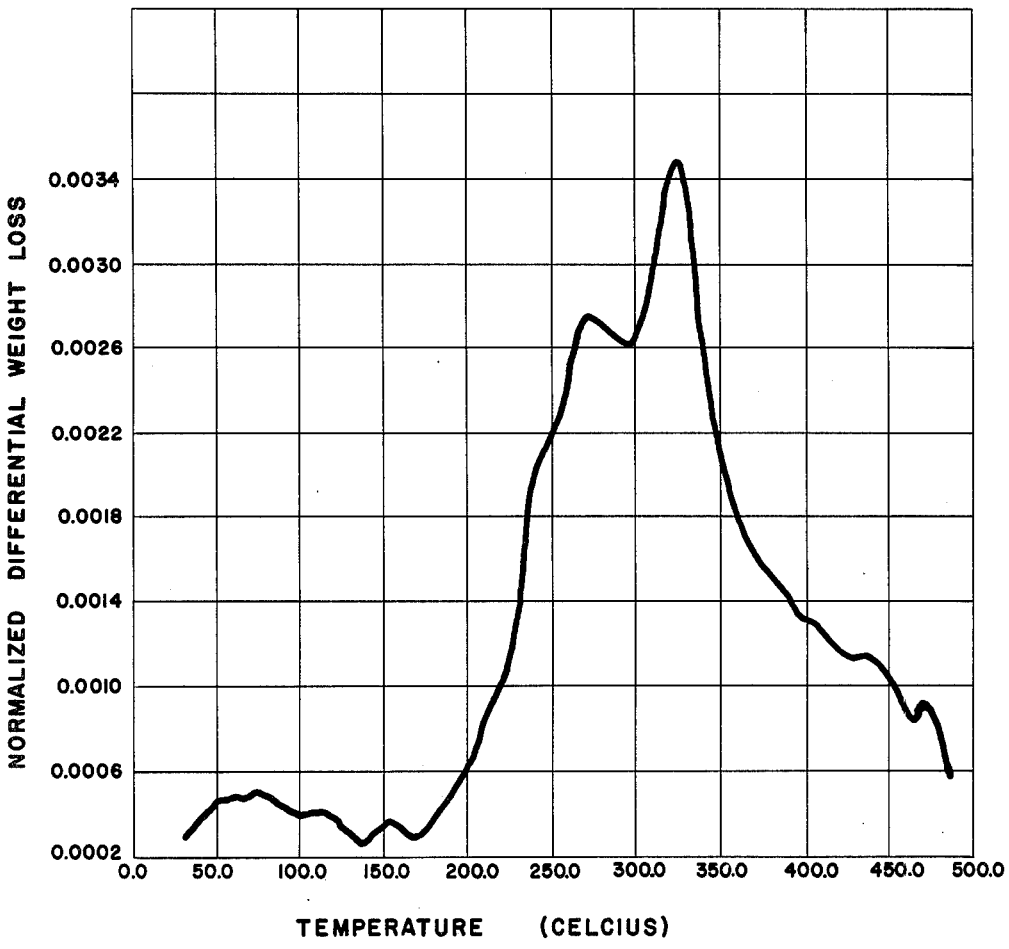
FIG. 6 is a derivative thermogravimetry curve of bright tobacco following treatment according to the process of the present invention.

FIG. 6 illustrates graphically the thermogravimetric analysis of bright tobacco similar to that shown in FIG. 5 with the exception that the tobacco has been treated according to the process of the present invention. One can establish from this curve that tobacco constituents have been substantially removed from the tobacco in a narrow and well-defined temperature range of 165 ± 5° C.

Figure 7:
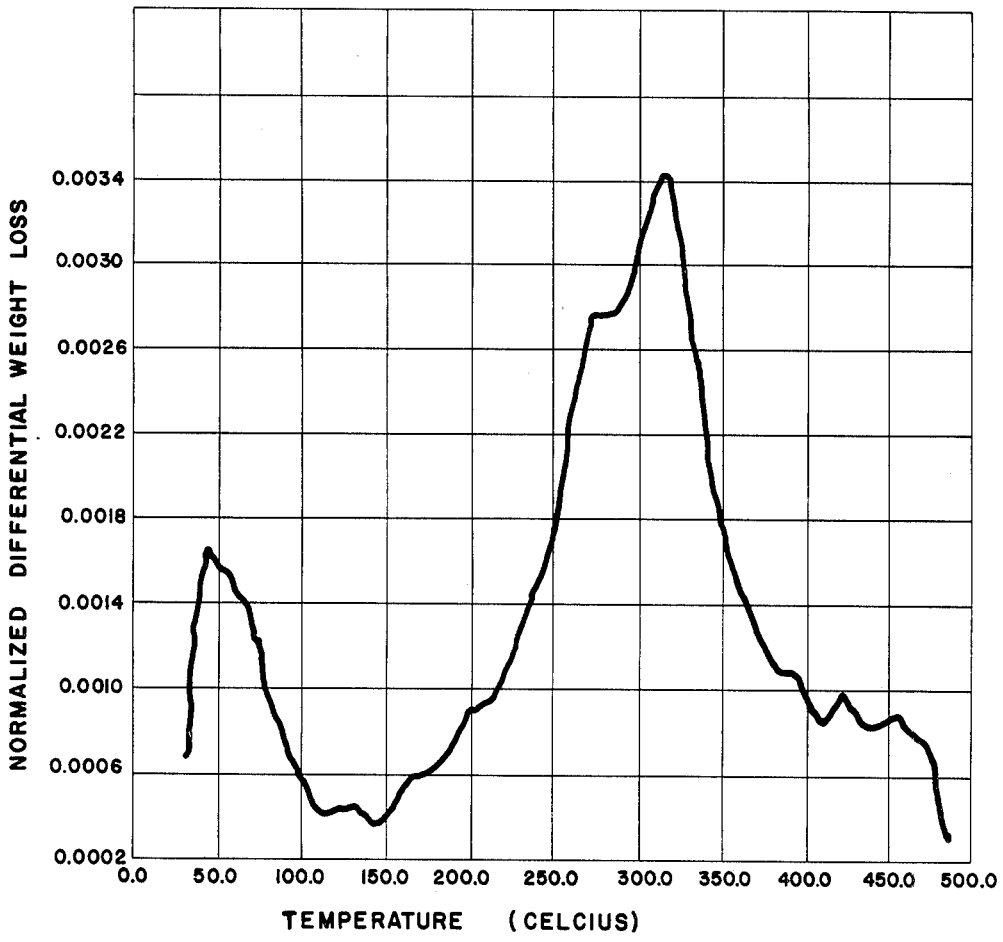
FIG. 7 is a derivative thermogravimetry curve of a low flavor, low quality tobacco.

FIG. 7 is illustrative of thermogravimetric analysis of a low flavor, low quality bright tobacco. The graph visually demonstrates the absence of tobacco volatiles in the temperature range of 165 ± 5° C.

The following examples are illustrative:

EXAMPLE 1

Using the apparatus shown in FIG. 1 and 2, a 55 g sample of a high flavor bright tobacco, in the form of cut filler, and which contained 12 percent oven volatiles, was placed loosely in the test tube, and the sparger assembled, inserted into the oven and connected to the nitrogen supply. The tobacco was identifiable as a high flavor tobacco by commonly employed subjective means and thermogravimetric analysis.

Nitrogen at room temperature and atmospheric pressure was allowed to purge the system of air for 30 minutes, then, the thermostat was set and maintained at 165° C. while the nitrogen, at 165° C. and atmospheric pressure was passed in contact with the tobacco. The condensing tube was maintained at 25° C. After the flow of nitrogen was stopped and the apparatus had cooled, the cap and condenser were removed and the condensate therein was recovered by washing several times with a total of about 50 cc of 95 percent ethanol. This was combined with the ethanolic solution in the receiver (about 50 cc). The final weight of the tobacco residue was measured and found to be 44.8 g, corresponding to a total weight loss of 18.5 percent. The weight loss (discounting oven volatiles) was 6.5 percent.

The recovered condensate, dissolved in ethanol, was sprayed onto 124 g of low flavor bright tobacco (having a tar delivery of 14.4 mg and a nicotine delivery of 0.98 mg) with continuous agitation for 15 minutes. The tobacco was identifiable as a low flavor tobacco by commonly employed subjective means, as well as by thermogravimetric analysis. The treated tobacco was equilibrated with occasional turning, for 24 hours, in order to achieve thorough permeation of the tobacco by the solution. The tobacco was conditioned for serveral days at 60 percent relative humidity and 75° F., after which the tobacco had a normal appearance and hand. Cigarettes were made from this treated tobacco which were normal in every outward manifestation, using a regular paper and a cellulose acetate filter tip of standard design. For convenience, these cigarettes are called Brand A.

In addition to Brand A, control cigarettes were prepared from untreated low tar, low flavor bright tobacco of the same kind as above and from untreated high flavor tobacco, of the same kind as used in the sparging operation; these are referred to as Brands B and C, respectively.

Brands A, B, and C were evaluated by a trained smoking panel (a select group of smokers accustomed to experimental cigarettes) which produced a profile of quantitated "character notes" for each brand. The responses for the three brands are shown in Table 1 below.

Table 1

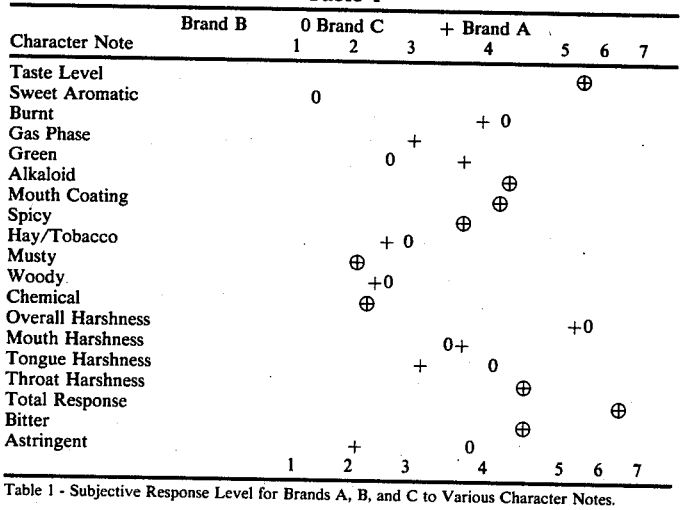

Table 1 - Subjective Response Level for Brands A, B, and C to Various Character Notes.

In 9 out of 19 cases, where Brands B and C were clearly distinguishable, Brands A and C were indistinguishable. In seven cases out of 19, the brands were found to be indistinguishable. In the remaining three cases, there was marginal distinction in "burnt," Brand A overlapping both B and C. Although the latter pair were distinguishable; the same results can be applied to "tongue harshness;" in "green," Brands A and B were distinguishable, and Brand C overlapped both. The character note called "total response" is considered to be particularly significant, because it summarizes all taste and harshness values; there was a clear indication in this set of values that the spargate treatment transformed low flavor bright tobacco into a tobacco whose total response matched that of the high flavor bright tobacco. The same result is obtained from taste level and overall harshness considered independently. It is apparent that the character notes of the high flavor bright tobacco were conferred upon the low flavor bright tobacco by the process of sparging.

The tar and nicotine values for each of these brands was determined by a standard method. The results are shown in Table 2. The flavor and aroma improvement of Brand A was achieved with only slight increases in these measurements. The trained smoking panel concluded that the treatment improved the flavor and aroma of low flavor bright tobacco, and made the smoke "smoother." The treatment, therefore, changed a flavor-deficient low-tar tobacco into a prominently-flavored bright tobacco, without altering its status as a low-tar tobacco.

Table 2

| Brand | Tar | | Nicotine | | Puff |
|---|---|---|---|---|---|
| | Mg/Cigt | Mg/Puff | Mg/Cigt | Mg/Puff | Count |
| B | 14.9 | 1.54 | 1.11 | 0.114 | 9.7 |
| A | 15.9 | 1.63 | 1.43 | 0.147 | 9.7 |
| C | 24.3 | 1.99 | 2.73 | 0.223 | 12.2 |

EXAMPLE 2

A series of runs were conducted using the large batch sparging apparatus shown in FIG. 3. For each run, the chamber was charged with 455 g of cut high flavor tobacco (characterized as in Example 1) which was contacted with 1600 SCCM nitrogen at 165° C. and 15 p.s.i.a. at an oven temperature of 165° C. and a tobacco temperature of 165° C. producing a residue of approximately 360 g and spargate.

The spargate was recovered partially by a flask condenser maintained at 0° C. and partially by filtration through two pounds of cut tobacco of the type to be flavored by the spargate maintained at 25° C. The recovery from the traps used in tandem (flask ahead of tobacco) appeared to be complete.

To obtain 4 pounds of flavored low tar, low flavor bright tobacco, two fresh charges of the tobacco were used, each for the successive sparging of two one-pound aliquots of high flavor bright tobacco. These charges were combined and sprayed with an alcoholic solution of combined spargates collected in the flask condenser.

Machine-made cigarettes were produced from the flavored bright tobacco so prepared and from an equal quantity of untreated bright tobacco. A trained panel of smokers compared these cigarettes and concluded that the untreated tobacco cigarettes possessed more "sweet aromatic" and "sweet basic" properties, while the treated cigarette was superior in "total response," "taste level," "alkaloid," "spicy," and "overall tongue and throat harshness."

EXAMPLE 3

Using the continuous sparging apparatus of FIG. 4, cut tobacco from a conventional feeder and hopper was fed at about 1 lb./hr. in a uniform layer to the belt running at approximately 2.4 in./min.

Nitrogen at room temperature and atmospheric pressure and at 10 CFH was supplied to each of the end chambers and at 90 CFH to the sparging chamber. Nitrogen, at 165° C. and one atmosphere, was withdrawn by means of a pump and passed through a conventional trap system to deposit most of the volatiles emanating from the tobacco during passage through the sparging chamber. These trapped volatiles possessed flavorant properties characteristic of the original tobacco and were useful for conferring flavors on a blend containing other types of tobacco. The tobacco residues from the continuous sparger are reduced in flavor when smoked as cigarettes.

EXAMPLE 4

A spargate from 55 g of highly-flavored bright tobacco was produced by the process described in Example 1. This spargate was applied to 124 g of a bright tobacco whose flavor level was low. The application consisted in spraying the alcoholic solution of the condensed volatiles on the shredded low flavor tobacco. The smoke of the cigarettes made from the low-flavored tobacco so treated were deemed indistinguishable in respect to bright tobacco character from those made from high-flavored tobacco.

EXAMPLE 5

A bright tobacco flavorant was produced by the process described in Example 2 and was sprayed on flavor-deficient bright tobacco to upgrade its flavor.

EXAMPLE 6

Oriental tobacco was sparged according to the method of Example 3. The flavorant produced was applied by spraying the ethanolic solution on a blend of bright and burley in lieu of the Oriental component customarily used. The cigarettes made from the thus cased blend were similar in their smoke flavors to cigarettes made from a blend containing the normal Oriental component.

EXAMPLE 7

The residue from sparging Oriental tobacco as described in Example 6 was reordered and made into cigarettes. These cigarettes were judged extremely mild and very weak in Oriental character.

EXAMPLE 8

The residue from sparging Oriental tobaccos according to the process of Example 3 was incorporated into cigarettes, which were characterized as resembling cigarettes made from bright, not Oriental tobacco, in respect to smoke flavor.

EXAMPLE 9

Using the apparatus shown in FIG. 1, 4.5 g of low flavor tobacco, confined within a glass tube, was used as the receiver for spargate from 4.5 g of high-flavor tobacco. Cigarettes prepared from the spargate-treated tobacco were found to have their type-characteristic smoke flavors enhanced.

EXAMPLE 10

Using the continuous sparging apparatus and the same operating conditions as used in Example 3, except that carbon dioxide gas was used instead of nitrogen, a similar bright tobacco was processed and the volatiles emanating from the tobacco during passage through the sparging chamber were trapped. These trapped volatiles were found to possess identical flavorant properties to volatiles trapped using a nitrogen atmosphere, ween they were applied to a low flavor tobacco.

What is claimed is:

1. In a process for treating tobacco including the steps of (1) contacting tobacco that contains naturally occurring flavorants with a stream of nonreactive gas under conditions whereby the tobacco is heated to volatilize said flavorants, (2) condensing said flavorants of the resulting gaseous stream to form a condensate, and (3) recovering said condensate, the improvement which comprises heating the tobacco in a temperature range of about 140° to about 180° C. for a period of time sufficient to recover a selected set of the flavorants contained therein, said heating being effective to achieve a weight loss of the tobacco of from about 3 to about 10% in excess of the weight loss represented by oven volatiles.

2. The improved process of claim 1 wherein the tobacco is heated in a temperature range of about 160° to about 170° C. and for a time period of about 3 to about 10 minutes.

3. A smoking material comprising the residue left from the treatment of Oriental tobacco by the process of claim 1.

4. In a process for preparing low-tar tobacco-based filler material of enhanced organoleptic properties, including the steps of (1) contacting a high-tar, high flavorant tobacco with a nonreactive gas under conditions whereby the tobacco is heated to volatilize flavorants contained therein, (2) condensing said flavorants of the resulting gaseous stream to form a condensate, (3) recovering the condensate, and (4) combining the condensate with a low-tar tobacco-based filler material in an amount sufficient to achieve enhanced flavor in its smoke, the improvement which comprises heating the tobacco in a temperature range of about 140° to about 180° C. for a period of time sufficient to recover a selected set of said flavorants, said heating being effective to achieve a weight loss of the tobacco of from about 3 to about 10% in excess of the weight loss represented by oven volatiles.

5. A cigarette containing low tar tobacco-based filler material prepared according to the process of claim 4.

6. The improved process of claim 4 wherein the tobacco is heated in a temperature range of about 160° to 170° C. and for a time period of about 3 to about 10 minutes.

* * * * *

UNITED STATES PATENT AND TRADEMARK OFFICE

CERTIFICATE OF CORRECTION

PATENT NO. : 4,150,677

DATED : April 24, 1979

INVENTOR(S) : J. Scott Osborne, Jr.; Homer A. Hartung; Joseph F. Bebbs, Jr.

It is certified that error appears in the above-identified patent and that said Letters Patent are hereby corrected as shown below:

Abstract, line 8, "togacco" should read —tobacco—.

Column 8, line 16, "insert" should read —inert—.
Column 9, lines 36-56, Table 1 should appear as follows (symbol □ for Brand B):

UNITED STATES PATENT AND TRADEMARK OFFICE

CERTIFICATE OF CORRECTION

PATENT NO. : 4,150,677

DATED : April 24, 1979

INVENTOR(S) : J. Scott Osborne, Jr.; Homer A. Hartung; Joseph F. Bebbs, Jr.

It is certified that error appears in the above-identified patent and that said Letters Patent are hereby corrected as shown below:

Table 1

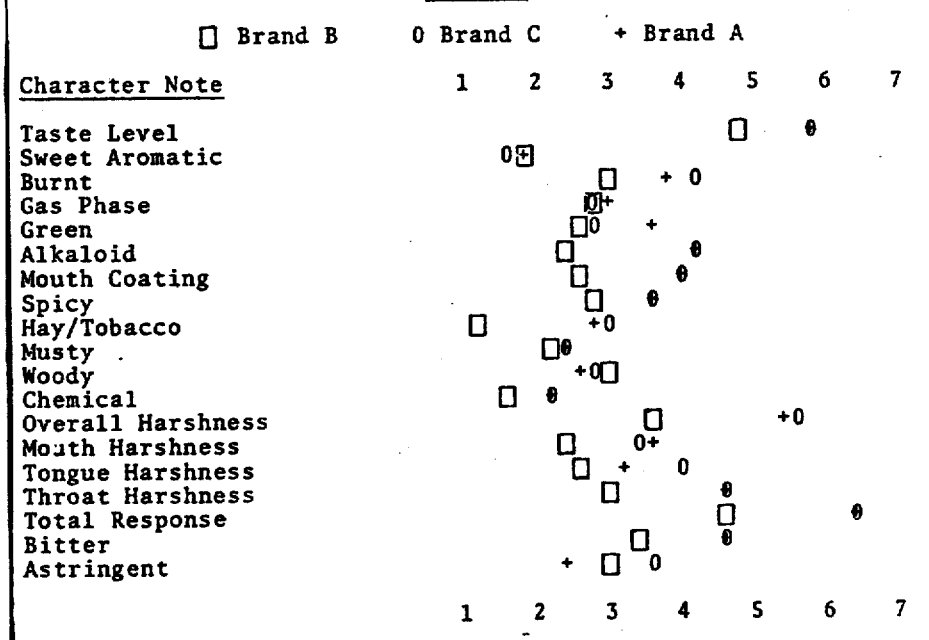

Table 1 - Subjective Response Level for Brands A, B, and C to Various Character Notes.

Signed and Sealed this

Sixth Day of November 1979

[SEAL]

*Attest:*

RUTH C. MASON
*Attesting Officer*

LUTRELLE F. PARKER
*Acting Commissioner of Patents and Trademarks*